United States Patent [19]

Desaules

[11] 3,982,386

[45] Sept. 28, 1976

[54] WATCHES, AND A METHOD OF MAKING THEM

[76] Inventor: Jean-Jacques Desaules, 3, rue Beau-Site, 2416 Les Brenets, Switzerland

[22] Filed: May 16, 1975

[21] Appl. No.: 578,113

Related U.S. Application Data

[63] Continuation-in-part of Ser. No. 343,436, March 21, 1973, abandoned.

[30] Foreign Application Priority Data

Mar. 23, 1972 Switzerland ..... 4318/72
Mar. 23, 1972 Switzerland ..... 4319/72

[52] U.S. Cl. ..... 58/1 R; 58/57
[51] Int. Cl.[2] ..... G04F 1/00
[58] Field of Search ..... 58/126 R, 126 A, 127 R, 58/148, 88 R, 88 E, 88 G, 104, 105, 58, 59, 57, 1 R; 156/293, 298, 264, 265, 303.1; 40/2 R, 334

[56] References Cited

UNITED STATES PATENTS

| | | | |
|---|---|---|---|
| 2,152,161 | 3/1939 | Sypher | 40/334 X |
| 2,984,596 | 5/1961 | Franer | 40/2 R X |
| 3,649,423 | 3/1972 | Wilton et al. | 40/2 R X |

FOREIGN PATENTS OR APPLICATIONS

| | | | |
|---|---|---|---|
| 617,884 | 2/1927 | France | 58/127 R |
| 1,075,905 | 10/1954 | France | 58/127 R |
| 531,342 | 1/1941 | United Kingdom | 156/303.1 |

*Primary Examiner*—Ulysses Weldon
*Attorney, Agent, or Firm*—Robert E. Burns; Emmanuel J. Lobato; Bruce L. Adams

[57] ABSTRACT

A small recess is provided in a plate surface portion of each of numerous watch movements, the surface portion being visible during service and repair of the watch movement. A similarly small plaque, carrying microscopic sequential marking numbers, is stuck in each recess. The plaques are cut from a transparent film carrying the microscopic sequential markings on one face thereof. Each plaque is applied in its recess with the marked surface downwards.

10 Claims, 4 Drawing Figures

FIG. 1
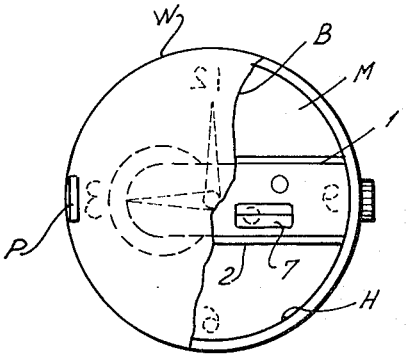
FIG. 2
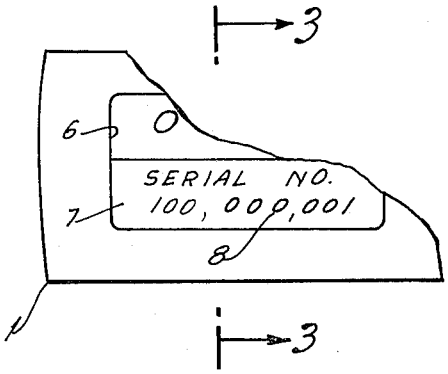
FIG. 3
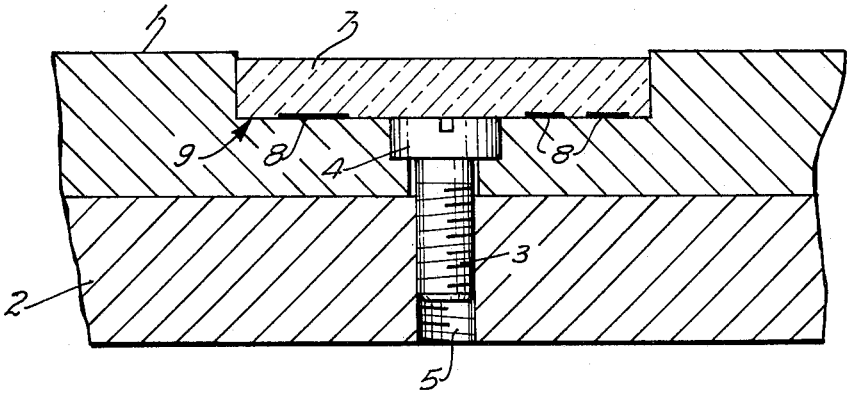
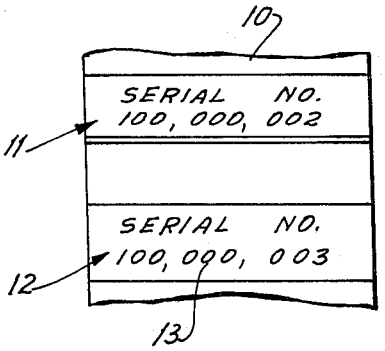
FIG. 4

WATCHES, AND A METHOD OF MARKING THEM

CROSS REFERENCE TO EARLIER APPLICATION

This is a continuation-in-part of the present applicant's earlier application, Ser. No. 343,436, filed Mar. 21, 1973 now abandoned.

BACKGROUND OF THE INVENTION

The invention relates to watches having watch movements with sequential markings, such as reference or series numbers, applied to small surface portions thereof. The marked surface portions are considerably smaller than the radius of the watch dial. The markings themselves, typically comprise serial numbers running to multiples of three places, for example to six places. Accordingly they use numerals of microscopic size.

Serial markings are at present applied by automatic engraving. Generally this is done at the beginning of manufacture of each movement, by sequentially engraving plate portions of consecutive watch movements; at the latest, the conventional marking is applied to each movement before its final assembly. The conventionally engraved parts are thus in danger of being scratched or otherwise inadvertently damaged during assembly. In case of such damage, a fresh unengraved part must be supplied. It must then be engraved by hand or by means of a pantograph, since an automatic engraving machine, set to engrave suitable numbers in a series or sequence of watch movements, could only with difficulty be stopped and set back to a prior state.

An object of the invention is therefore to provide watch movements with serial markings in a new manner which obviates the indicated drawbacks.

SUMMARY OF THE INVENTION

The invention provides a new method of sequentially marking watch movements, and a new watch movement produced thereby. Small recesses are sunk into surface portions of a large number of uniform plate portions of watch movements. Each recess is disposed at a location visible during service and repair of the watch, and preferably visible only during service and repair. Corresponding numbers of small plaques, each fitting into one of the recesses, are provided, preferably by cutting the plaques from a film band. Each plaque carries a sequential number, comprising more than three microscopically small numerals. Each plaque is secured to one of the plates, in the corresponding recess, preferably by gluing.

BRIEF DESCRIPTION OF THE DRAWING

In the drawing,

FIG. 1 is a rear view, partly broken away, of a watch having a movement marked according to the invention;

FIG. 2 is an enlarged detail from FIG. 1;

FIG. 3 is a more enlarged cross-sectional view taken along line 3—3 in FIG. 2; and FIG. 4 is an enlarged, partial plan view of a film used in accordance with the new method.

DESCRIPTION OF PREFERRED EMBODIMENTS

As shown in FIG. 1, movement M of watch W is inserted in watch housing H, coaxially with the watch dial which has dial figures D. Movement M is visible and accessible for service and repair when back cover B of housing H is opened; for example by swinging it about pivot or hinge P. At other times in the use of watch W, movement M is generally hidden in housing H.

Movement M comprises a plate portion 1 and a bridge 2, interconnected by a screw 3 whose head is engaged in countersunk bore 4 in plate 1 and whose shank engages a tapped bore 5 of bridge 2. In the upper surface of plate 1, visible for service, is a rectangular or oblong recess 6, having a maximum extension over watch movement M which is small, compared with the length of the minute hand, or with an entire radius of watch movement M. A transparent rectangular plaque 7, the thickness of which is slightly less than the depth of recess 6, is fixed in recess 6 and attached to plate 1 by a layer 9 of adhesive on a surface of the plaque. The plaque 7 carries on this attached surface a series marking 8, visible through the transparent plaque.

The plaque 7 thus forms a seal covering the bore 4 and screw 3. Access to the screw 3, for dismantling the movement can thus only be achieved by removal of plaque 7. Preferably the plaque is of dimensions closely fitting into recess 6, so that unauthorized removal of the plaque would necessarily involve damage to the plate 1 and watch movement M.

The markings 8, as best shown in FIG. 2, comprise a serial number which runs into multiples of three places. As shown, they provide nine places, for a series of several hundred millions of movements. They at least provide more than three places, for a series of some thousands of movements. Accordingly, each of the several numerals of markings 8, on a plaque which is small compared with the radius of movement M, is of microscopic size; it is shown enlarged in FIG. 2.

The plaque 7, instead of being transparent, can also be, for example, a photographically marked piece of metal, such as an anodized, printed slab of aluminum. The markings in this case are provided on the upwardly exposed outer surface of the plaque 7.

The use of a transparent plaque 7, with markings 8 of a color contrasting with the color of recess 6 is preferred as it protects the markings from damage for example by inadvertent scratching during the assembly of the unit. It also minimizes the cost of production of the required set of plaques.

The described watch movements M are mass-produced as follows. Prior to assembly of the component parts of each movement M, the recess 6 is sunk into plate 1, by milling, stamping or in any other known manner, at a selected location that will be visible and accessible for service and repair after assembly. The complete movement M, or in some cases the complete watch W, is then assembled, the access to bore 4 for the purposes of turning the screw 3 being achieved through recess 6. This can be done uniformly with respect to each plate 1 of a large number of uniform movements M.

Corresponding number of plaques 7 are advantageously provided, by cutting an elongate band 10 carrying therealong a plurality of discrete sequential marking areas, each including sequential numbers 11,12 . . . (FIG. 4), to provide a plurality of plaques 7 the dimensions of which correspond to the given dimensions of recesses 6 in the assembled watch movements. Band 10 can be a transparent film carrying therealong, on one surface, the sequential markings 8, including numbers 11,12 . . . , which comprise microscopically small numerals 13, that is, numerals of such minute height as to be normally legible only with the aid of a magnifier or microscope, as commonly used by watch makers. Each plaque 7 thus serially identifies the corresponding watch movement M, and in due course the corresponding watch W. It provides such identification substantially without interference with the other small portions of the watch movement. It provides the identification at minimal cost, as a film band 10 with the required series of numbers 11,12 . . . is readily and cheaply available. Even in the event that one of the serial numbers 11,12, . . . is scratched or otherwise damaged, in any further stages of the assembly processes, only minimal costs are incurred by either (1) duplicating the film band or a portion thereof or (2) utilizing a new film band portion, and in either case, replacing the damaged plaque by a new plaque 7.

The plate portions 1, including recesses 6 for housing the plaques 7, can be plate-like members having a generally flat surface. For example, they can be provided by bottom plates, bars, bridges, or cocks of watch movements, or back covers of watches.

The described marking has the distinct advantage that the new, microscopically marked plates can be provided at a considerably lower cost than conventional, correspondingly engraved plates for watch movements or portions thereof. It has the further advantage that it avoids any need for a newly marked watch movement portion because of any damage due to markings incident to assembly operations, the new marking being conveniently applicable after substantial completion of these operations. Moreover the plaques can conveniently be used as a seal, and the aspect of the markings on the plaques can be made as aesthetic as may be desired.

What is claimed and desired to secure by Letters Patent is:

1. A method of making watch movements with sequential serial markings, comprising;

making a recess in a surface porton of each of a series of plate portions of uniform watch movements, at a location which is visible during service and repair of the corresponding watch movement, the recess having a maximum extension over the plate portion which is small compared with a radius of the watch movement;

fitting a series of plaques, each into one of the recesses, each plaque carrying a sequential serial marking; and attaching the fitted plaque to each of said plate portions, in the corresponding recess, to sequentially serially mark the watch movements.

2. A method according to claim 1 in which the attaching of each plaque is performed after substantial completion of assembly of the corresponding watch movement.

3. A method of making watch movements with sequential serial markings, comprising;

making a recess in a surface portion of each of a series of plate portions of uniform watch movements, at a location which is visible during service and repair of the corresponding watch movement, the recess having a maximum extension over the plate portion which is small compared with a radius of the watch movement; completely assembling the watch movement corresponding with and including each plate portion; and thereafter fitting a series of plaques, each into one of the recesses, each plaque carrying a sequential serial marking comprising a set of more than three microscopically small symbols; and attaching each fitted plaque to the corresponding plate portion, in the corresponding recess, to sequentially serially mark the watch movements.

4. A method according to claim 3 including; providing a transparent film with sequential serial numbers thereon; and cutting said film into film portions to provide said plaques.

5. A method according to claim 4 including; providing said film with said numbers on one face thereof; and securing each plaque to the corresponding plate portion in the recess, with said one face downwards.

6. A method of making watch movements with sequential serial markings, comprising;

making a recess in a surface portion of each of a series of plate portions of uniform watch movements, at a location which is visible during service and repair of the corresponding watch movement, the recess having a maximum extension over the plate portion which is small compared with a radius of the watch movement;

securing each plate portion to an underlying element of the corresponding watch movement by fastening the element to the plate portion by a fastener disposed in said recess; and thereafter fitting a series of plaques, each into one of the recesses, each plaque carrying a sequential serial marking composed of microscopically small symbols, and attaching the fitted plaque to each of said plate portions, in the corresponding recess, to sequentially serially mark the watch movements and to seal the recess.

7. A plate and marker assembly for a watch movement comprising;

a plate usable as part of a watch movement and uniform with plates so usable for a large series of such movements, the plate having a surface portion thereof disposed at a location which is visible and accessible during service and repair of the respective watch movement and having a recess in said surface portion which recess has a maximum extension over the plate which is small compared with a radius of the watch movement; and a plaque attached to the plate in the recess, substantially filling the recess, and carrying a sequential marking composed of more than three microscopically small numerals to distinguish said plate from the plates of the other watch movements of the series.

8. A plate and marker assembly according to claim 7, in which the plaque is transparent, has a surface secured to the plate in the recess, and carries said marking on said surface.

9. A plate and marker assembly according to claim 7, in which the plaque is a slab of metal having one surface imprinted with said marking and having its opposite surface secured to the plate in the recess.

10. A plate and assembly according to claim 7, also having an element at least partly underlying said plate; fastening means for securing the plate to said element; and means, including the plaque, for covering the fastening means, the plaque being substantially opaque.

* * * * *